US008769910B2

(12) United States Patent
Beaudoin

(10) Patent No.: US 8,769,910 B2
(45) Date of Patent: Jul. 8, 2014

(54) TOP-CHORD BEARING JOIST

(75) Inventor: Michel Beaudoin, Saint-Ephrem-de-Beauce (CA)

(73) Assignee: Poutrelles Modernes, Ltee, Saint-Ephreu-de-Beauce (CA)

( * ) Notice: Subject to any disclaimer, the term of this patent is extended or adjusted under 35 U.S.C. 154(b) by 321 days.

(21) Appl. No.: 13/162,995

(22) Filed: Jun. 17, 2011

(65) Prior Publication Data

US 2011/0302872 A1 Dec. 15, 2011

(30) Foreign Application Priority Data

Jun. 10, 2010 (CA) ..... 2706104

(51) Int. Cl.
*E04C 3/02* (2006.01)
*E04H 12/00* (2006.01)
*E04B 1/38* (2006.01)

(52) U.S. Cl.
USPC ..... 52/692

(58) Field of Classification Search
USPC ..... 52/690, 692–694, 836, 837, 93.1
See application file for complete search history.

(56) References Cited

U.S. PATENT DOCUMENTS

| | | | | |
|---|---|---|---|---|
| 4,349,996 | A | 9/1982 | Lautensleger et al. | |
| 4,669,243 | A * | 6/1987 | Gore et al. | 52/696 |
| 4,982,545 | A | 1/1991 | Stromback | |
| 5,592,800 | A | 1/1997 | Koo et al. | |
| 5,761,872 | A * | 6/1998 | Sanford et al. | 52/694 |
| 5,867,963 | A * | 2/1999 | Hershey | 52/650.2 |
| 5,996,305 | A * | 12/1999 | Holbert et al. | 52/745.19 |
| 6,012,262 | A * | 1/2000 | Irving | 52/837 |
| 6,526,723 | B2 * | 3/2003 | Hovenier | 52/837 |
| 6,584,741 | B1 * | 7/2003 | Hatzinikolas | 52/289 |
| 7,240,463 | B2 | 7/2007 | Masterson et al. | |
| 7,356,974 | B2 | 4/2008 | Tadich | |
| 2002/0007611 | A1 * | 1/2002 | Sanford et al. | 52/694 |
| 2004/0020757 | A1 | 2/2004 | Deibele et al. | |
| 2006/0283133 | A1 * | 12/2006 | Westre et al. | 52/729.1 |
| 2007/0022707 | A1 * | 2/2007 | Gregg et al. | 52/735.1 |
| 2010/0263319 | A1 * | 10/2010 | Lemyre | 52/693 |

FOREIGN PATENT DOCUMENTS

| | | |
|---|---|---|
| CA | 2654720 | 5/2009 |
| CA | 2663093 | 7/2009 |
| GB | 2403740 | 1/2005 |

OTHER PUBLICATIONS

Truss Components, Engineered Truss Systems Roof & Floor, Floor Truss Guide http://www.trusscomponents.com/pdf/Floor%20Truss%20Guide.pdf (retrieved Nov. 10, 2011).

* cited by examiner

*Primary Examiner* — Brian Glessner
*Assistant Examiner* — Paola Agudelo
(74) *Attorney, Agent, or Firm* — Wiley Rein LLP

(57) ABSTRACT

A joist includes an outer top chord and a bottom chord; and an end configuration with at least one end of the joist and including a board connecting the top and bottom chords, an inner top chord underlying the outer top chord and defining therewith a double top chord section, a post extending between the bottom chord and the double top chord section, the double top chord section extending outwardly past the post.

29 Claims, 9 Drawing Sheets

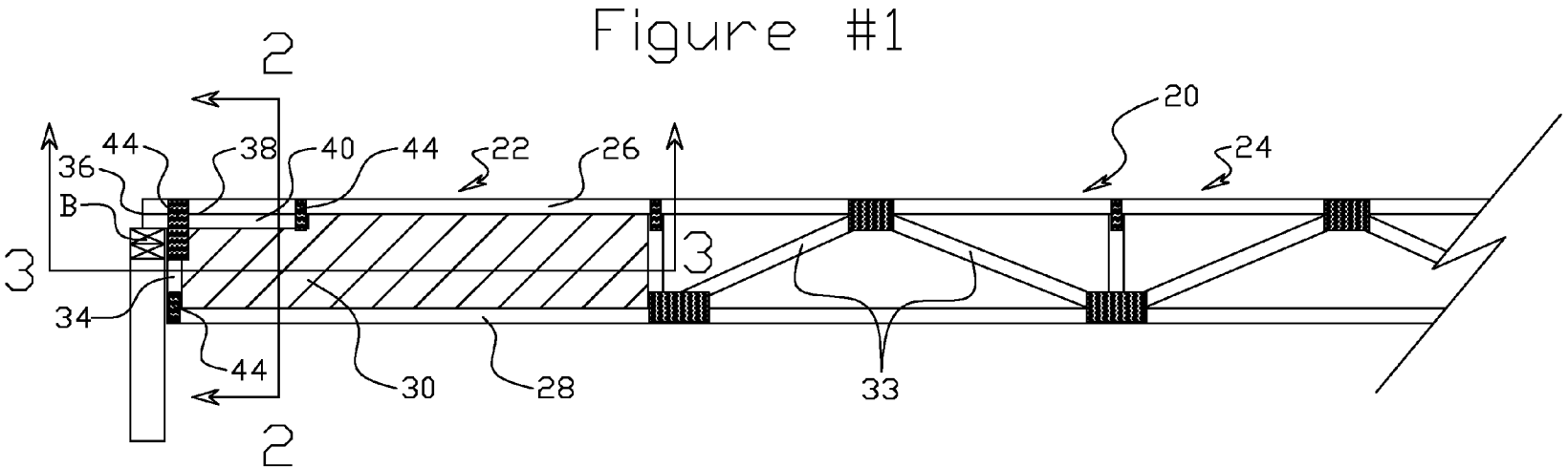
Figure #1
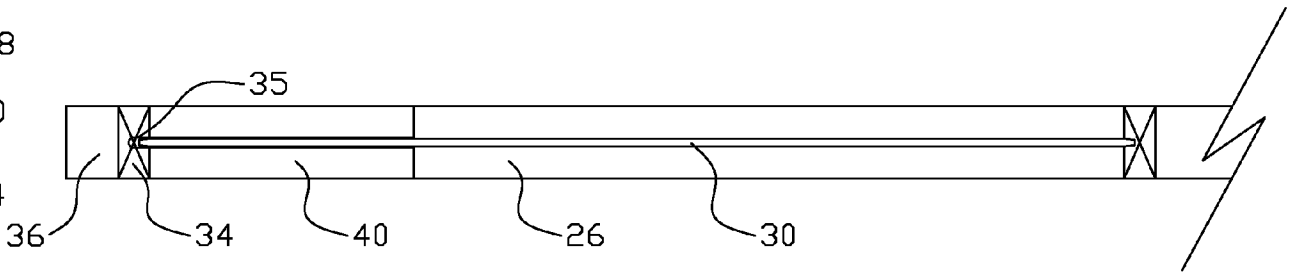
Figure #3
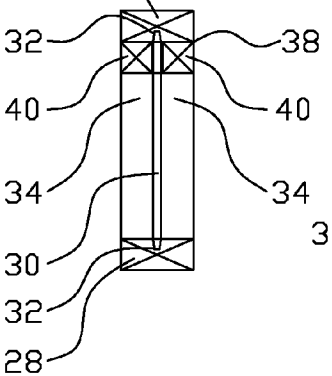
Figure #2

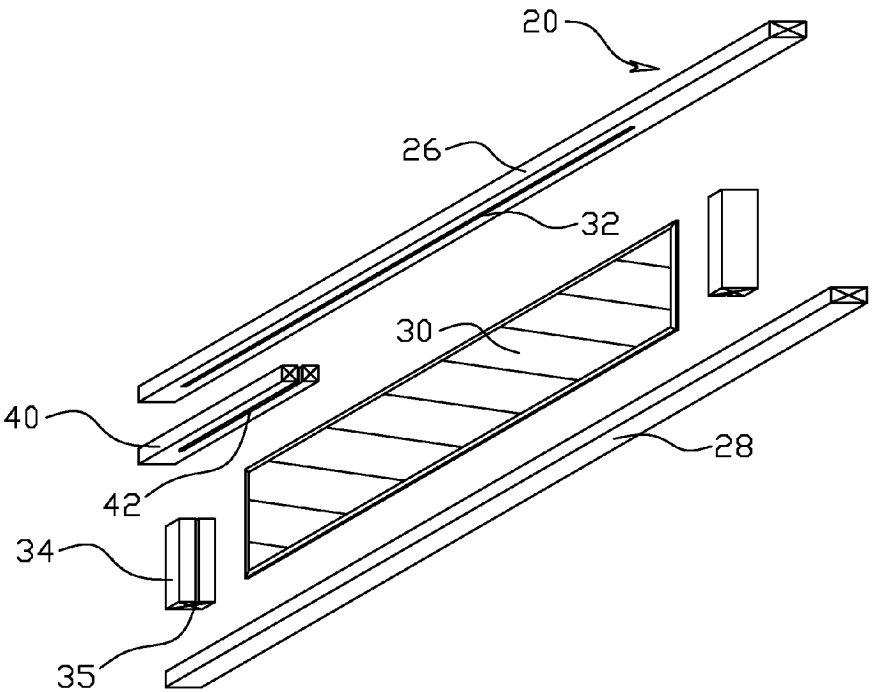
Figure #5
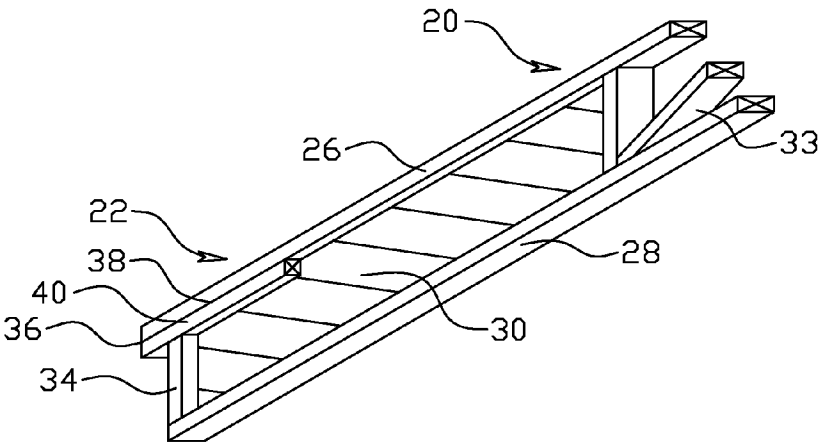
Figure #4

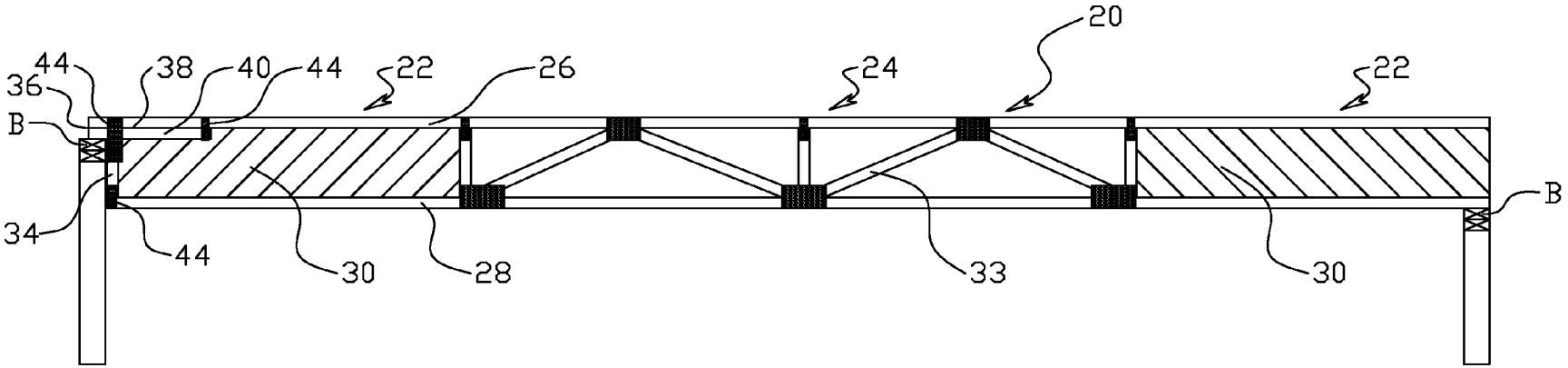
Figure #6

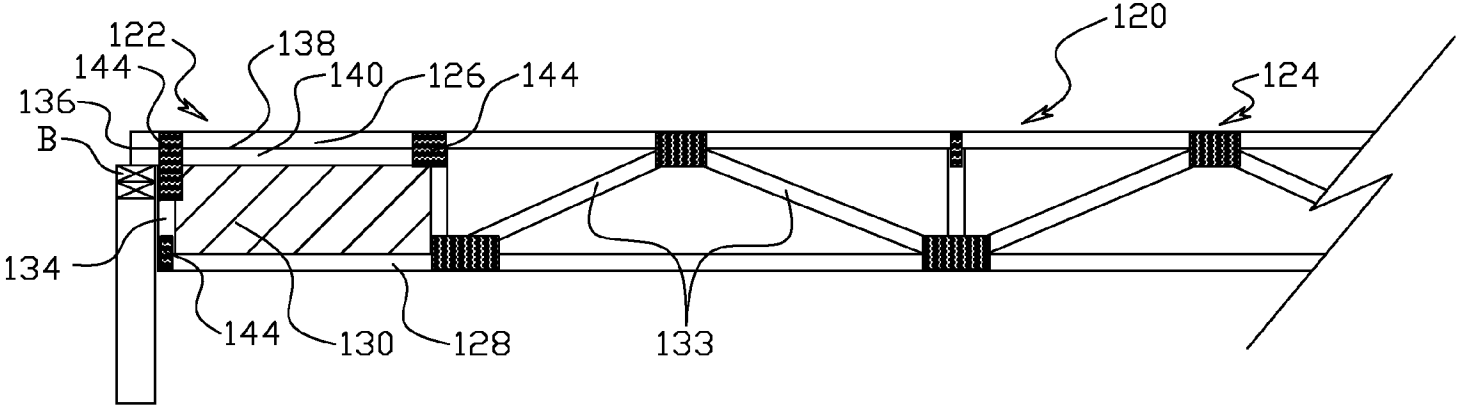
Figure #7
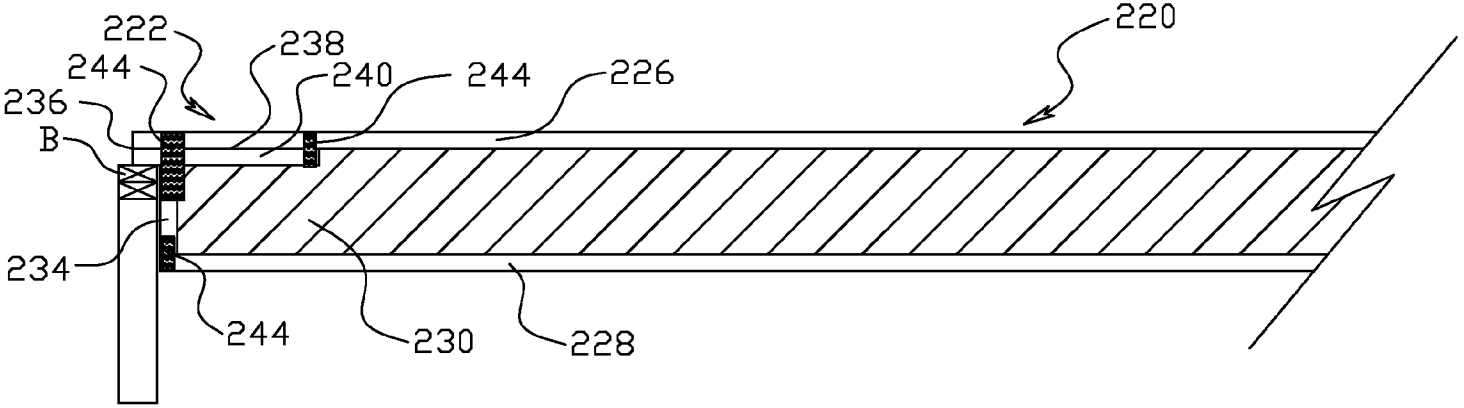
Figure #8

Figure #9
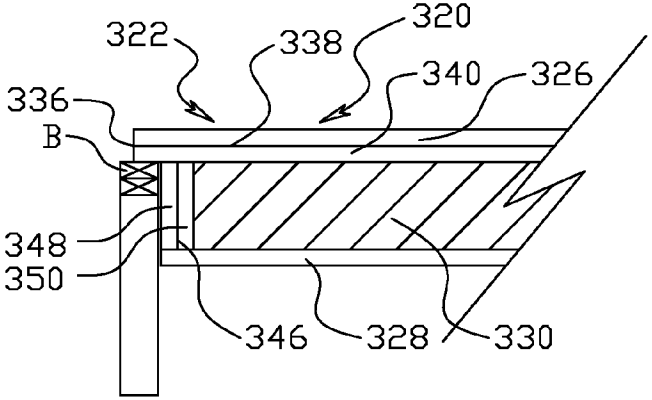
Figure #10
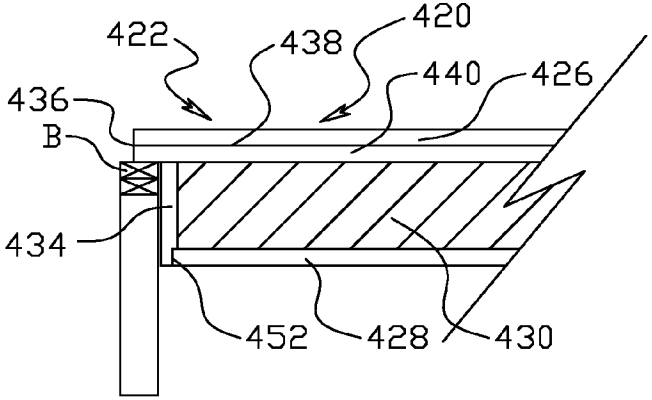

Figure #11
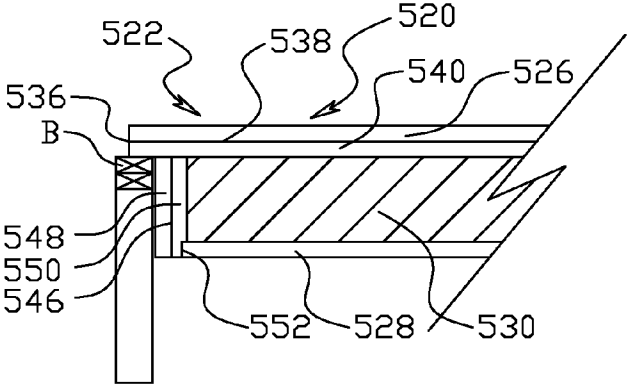
Figure #12
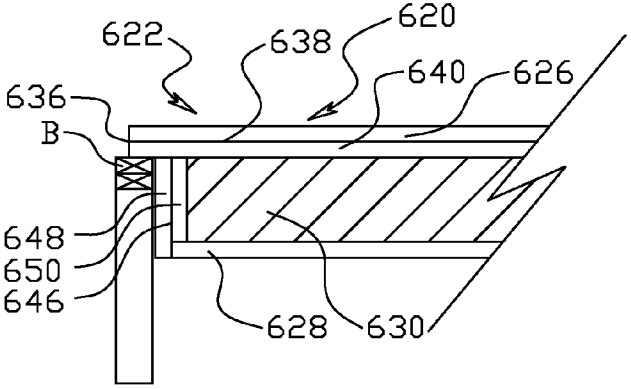

Figure #13
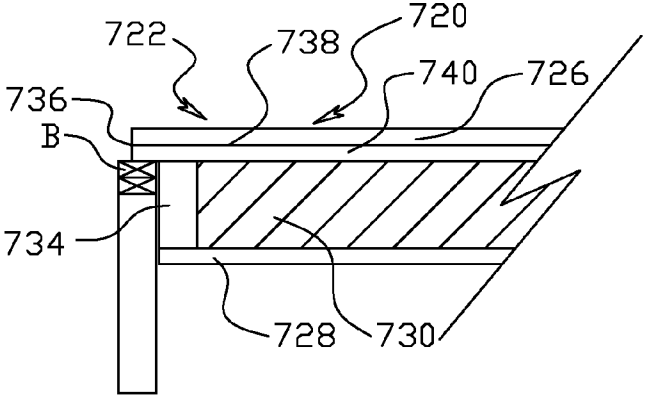
Figure #14
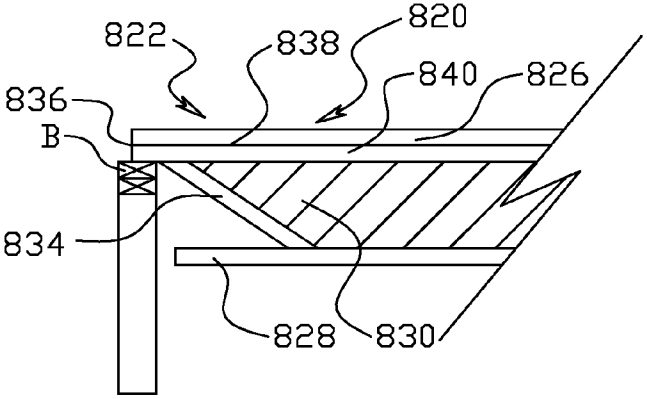

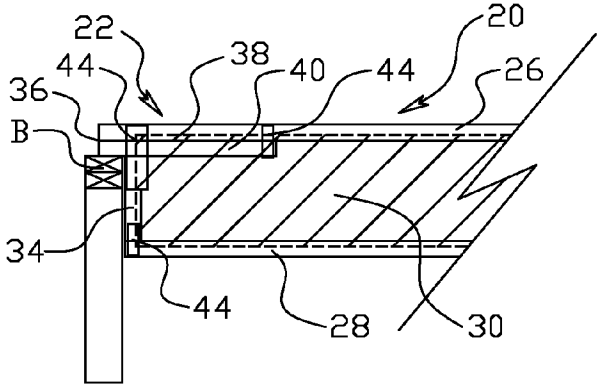
Figure #15
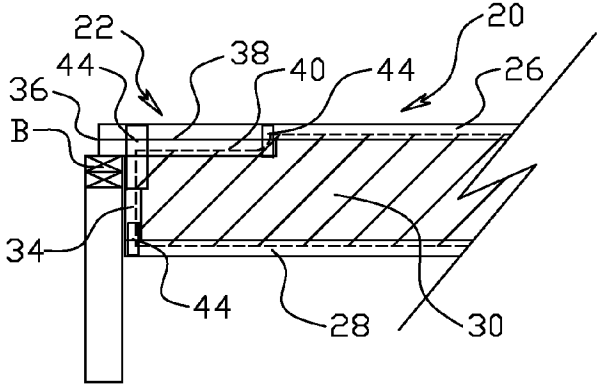
Figure #16

Figure #17
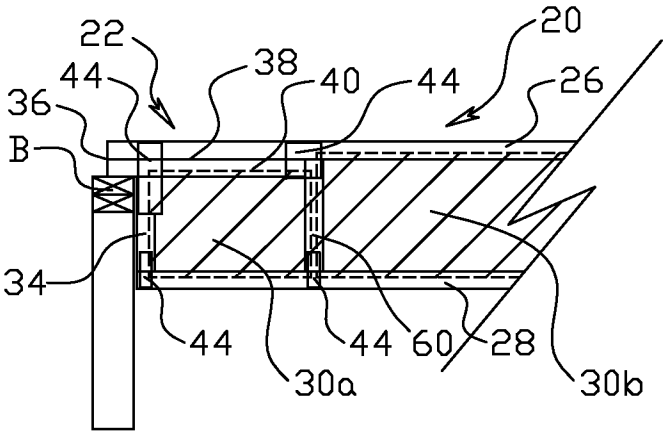

TOP-CHORD BEARING JOIST

CROSS-REFERENCE TO RELATED APPLICATIONS

This application claims priority of Canadian patent application 2,706,104 filed on Jun. 17, 2010, the specification of which is hereby incorporated by reference.

TECHNICAL FIELD OF THE INVENTION

The technical field relates to a joist used in building construction and, more particularly, to a joist used in a top-chord bearing configuration.

BACKGROUND

Wooden joists are used in a number of building applications. They include top and bottom elongated chords with intervening web members or boards joined to the chords.

Prefabricated joists typically include I-joist sections at the joist ends. The end sections are trimmable to quickly adjust the length of the resulting joist. However, these joists are typically supported by their bottom chord, i.e. bottom-chord bearing chord, when mounted to walls, beams, and the like. Joist hangers, i.e. metal connectors used to transfer loads from one member to another, are required to provide the appearance of a top-chord bearing joist. This appearance can be advantageous since at least a portion of the bearing structure, either beams or wall sections, is hidden inside the floor.

There is thus a need for mounting joists having an I-joist end section in a top-chord bearing configuration, meaning that they are supported by the underside of the top chord, so that the top chord extends longitudinally beyond the bottom chord.

BRIEF SUMMARY OF THE INVENTION

It is therefore an aim of the present invention to address the above mentioned issues.

According to a general aspect, there is provided a joist comprising: an outer top chord and a bottom chord; and an end configuration with at least one end of the joist and including a board connecting the top and bottom chords, an inner top chord underlying the outer top chord and defining therewith a double top chord section, a post extending between the bottom chord and the double top chord section, the double top chord section extending outwardly past the post.

According to another general aspect, there is provided a joist comprising: a bottom chord; a double top chord extending outwardly past the bottom chord at an end section of the joist and including an outer top chord member extending along the joist and an inner top chord having an elongated groove defined therein; a board connecting the double top chord and the bottom chord and having a section inserted in the elongated groove defined in the inner top chord; and a post extending in the end section of the joist between the double top chord and the bottom chord, the double top chord extending outwardly past the post.

According to a further general aspect, there is provided a joist comprising: a bottom chord; an outer top chord extending past the bottom chord at an end section of the joist; a board connecting the outer top and bottom chords and extending at least in the end section of the joist; an inner top chord underlying the outer top chord, extending past the bottom chord for supporting the joist in a top-chord bearing configuration, and having an elongated groove defined therein in which the board is inserted; and a post extending between the inner top chord and the bottom chord.

In an embodiment, the board extends through the elongated groove defined in the inner top chord and has an edge at least partially inserted in an elongated groove defined in the outer top chord.

In an embodiment, the board has an edge at least partially located in the elongated groove defined in the inner top chord.

In an embodiment, at least one of the outer top chord, the inner top chord, the bottom chord, and the post is a wooden member.

In an embodiment, the post is juxtaposed outwardly to the board and comprises an elongated post groove in which an outer edge of the board is at least partially inserted.

In an embodiment, the joist further comprises a first set of metal plates in alignment on opposed sides of the joist to connect the inner and outer top chords and an upper end of the post.

In an embodiment, the inner and the outer top chords define a joist extension extending outwardly past the bottom chord for supporting the joist in the top-chord bearing relationship.

In an embodiment, wherein the post is substantially perpendicular to the inner and the outer top chords and the bottom chord.

In an embodiment, the inner and the outer top chords are in direct juxtaposition and extend substantially parallel to one another.

In an embodiment, the inner top chord extends inwardly past the post.

In an embodiment, an end of the post abuts a lower face of the inner top chord.

In an embodiment, the joist further comprises a central section including at least one of a board and web members connecting the outer top and bottom chords.

In an embodiment, the joist further comprises metal plates securing an inner end of the inner top chord to the outer top chord.

BRIEF DESCRIPTION OF THE DRAWINGS

FIG. 1 is a schematic side elevation view of a joist end configuration in accordance with a first embodiment, wherein an inner top chord extends partially along a joist end section;

FIG. 2 is a schematic cross-sectional view along section lines 2-2 of FIG. 1;

FIG. 3 is a schematic cross-sectional view along section lines 3-3 of FIG. 1;

FIG. 4 is a perspective view of the joist-end shown in FIG. 1;

FIG. 5 is a perspective view, exploded, of the joist-end shown in FIG. 1;

FIG. 6 is a schematic side elevation view of the joist shown in FIG. 1 supported by two spaced apart beams in a top-chord bearing configuration at a first end and in a bottom-chord bearing configuration at a second and opposed end;

FIG. 7 is a schematic side elevation view of the joist end configuration in accordance with a second embodiment, wherein the inner top chord extends along the entire board of the joist end section;

FIG. 8 is a schematic side elevation view of the joist end configuration in accordance with a third embodiment, wherein the I-joist section extends along the entire joist;

FIG. 9 is a schematic side elevation view of the joist end configuration in accordance with a fourth embodiment, including a double post extending between a bottom chord and a double top chord;

FIG. 10 is a schematic side elevation view of the joist end configuration in accordance with a fifth embodiment, including a single post with an indentation;

FIG. 11 is a schematic side elevation view of the joist end configuration in accordance with a sixth embodiment, including a double post with an inner indented post;

FIG. 12 is a schematic side elevation view of the joist end configuration in accordance with a seventh embodiment, including a double post engaging the bottom chord;

FIG. 13 is a schematic side elevation view of the joist end configuration in accordance with an eighth embodiment, including a substantially thick vertically-extending post;

FIG. 14 is a schematic side elevation view of the joist end configuration in accordance with a ninth embodiment, including a diagonally-extending post;

FIG. 15 is a schematic side elevation view of the joist end configuration shown in FIG. 1, showing a board extending partially in an outer top chord and a bottom chord, through the inner top chord;

FIG. 16 is schematic side elevation view of the joist end configuration shown in FIG. 1, showing the board having an edge located in the inner top chord; and FIG. 17 is schematic side elevation view of the joist end configuration in accordance with a tenth embodiment, wherein the end section includes an inner vertical post.

It will be noted that throughout the appended drawings, like features are identified by like reference numerals.

DETAILED DESCRIPTION

Referring to the drawings, and more particularly to FIGS. 1 to 6, a structural truss, or joist, end configuration is illustrated. The joist 20 has two opposed end sections 22 (only one is shown in FIG. 1) with a central section 24 extending between the end sections 22 (only a portion of the central section 24 is shown). The joist 20 has an outer top chord 26 and a bottom chord 28, spaced apart from the outer top chord 26, and interconnected trough board(s), web(s), post(s) or combination thereof.

In the end section 22, the outer top chord 26 and the bottom chord 28 are interconnected through a board 30 and thereby define an I-joist section. As known in the art, the top and bottom chords 26, 28 have a groove 32 (FIGS. 2 and 5) defined therein in which the edges of the board 30 are inserted and secured, thereby defining an "I" shape cross-section.

In the embodiment shown, the top and bottom chords 26, 28 and the board 30 are wooden members. The board 30 can be made from plywood, laminated veneer lumber, oriented strand board (OSB), laminated solid wood panel, and the like.

The central section 24 of the joist 20 can be an open-joist with metal or wooden web members 33 interconnecting the top and bottom chords 26, 28 or the I-joist section can be continuous along the entire length of the joist 20 (see FIG. 8, for instance). In an alternative embodiment (not shown), the joist 20 can include a plurality of adjacent I-joist sections.

As mentioned above, at the end section 22 of the joist 20 shown in FIG. 1, the end configuration has a post 34, i.e. a column, extending between the top and bottom chords 26, 28 and adjacent outwardly to the board 30. The outer top chord 26 extends outwardly past the post 34 while the bottom chord 28 ends at the junction with the post 34, i.e. the outer top chord 26 projects beyond the bottom chord 28 at the end section 22 of the joist 20. Thus, the outer top chord 26 defines an extension 36 which is used to support the joist 20 when mounted to a beam B, as shown in FIGS. 1 and 6. In other words, the joist 20 is a top-chord bearing joist wherein the extension 36 is seated on the top of the beam B when the joist 20 is transversely positioned on the beam B. In an embodiment, the extension 36 is about two inches long. However, it is appreciated that the length of the extension 36 can vary in accordance with the needs.

In the embodiment shown, the post 34 extends substantially vertically, i.e. it is substantially perpendicular to the top and bottom chords 26, 28. The post 34 includes a groove 35 (FIGS. 3, 5, and 15 to 17) in which a lateral edge of the board 30 is inserted. However, it is appreciated that in an alternative embodiment, the post can be groove free.

In the end section 22 of the joist 20, the joist 20 includes a double top chord 38. The double top chord 38 includes a section of the outer top chord 26, which extends along the length of the joist 20, and an inner top chord 40, which is superposed inwardly to the outer top chord 26 along a section of the outer top chord 26. Both the outer top chord 26 and the inner top chord 40 define the extension 36 of the joist 20 which extends outwardly past the post 34 and the end of the bottom chord 28. As mentioned above, the extension 36 of the double top chord 38 supports the joist 20 when mounted to the beam B. The double top chord 38 increases the load bearing capacity of the joist 20.

The extension 36 is the interface of the double top chord 38 with beam B when the joist 20 is in a top-chord bearing relation with the beam B, as illustrated in FIGS. 1 and 6. Thus, the post 34, adjacent to the extension 36, is in tension in the top-chord bearing configuration of the joist 20. As mentioned above, the extension 36 extends outwardly past the post 34. In the embodiment shown, the extension 36 also extends outwardly past the end of the bottom chord 28. However, it is appreciated that, in an alternative embodiment, the bottom chord 28 can also extend past its intersection with the post 34 (see FIG. 14, for instance).

As shown in FIGS. 2, 5, and 15 to 17, the inner top chord 40 has an elongated groove 42 defined therein in which the board 30 is inserted. The inner top chord 40 is secured to the board 30 and the outer top chord 26. Doubling the top chord 38 at the end section 22 of the joist 20 increases the resulting joist strength and, more particularly its load bearing capacity. The upper end of the post 34 abuts the lower face of the inner top chord 40 and is secured thereto.

For securing the various components together, sets of metal plates, adhesives or combinations thereof can be used. For instance and without being limitative, metal plates having serrated surfaces that grip into the wooden components when pressed against them can be used. For securing two components, two metal plates, mounted on opposed sides of the joist 20, can be used. The metal plates can be paired up such that metal plates are in alignment on opposed sides of the joist 20. It is appreciated that several plates can be used on each side instead of only one. Finger joints can also be used to connect together the various components of the joists.

In the embodiment shown in FIG. 1, a pair of metal plates 44 (only one is shown, another metal plate is mounted on the opposed side of the joist) are used to connect together, the outer and inner top chord 26, 40 and the post 34.

In the embodiment described above in reference to FIGS. 1 to 3, adhesives can be used to secure the double top chord 38 and the bottom chord 28 to the board 30. Another set of metal plates 44 can be used to secure the post 34 to the bottom chord 28. In an alternative embodiment, no metal plate is needed to secure the post 34 and the bottom chord 28. Another pair of metal plates 44 can be used to secure an inner end of the inner top chord 40 to the outer top chord 26, as shown in FIGS. 1 and 6.

Referring to FIG. 6, there is shown an embodiment of an entire joist 20 mounted to two spaced apart beams. A first end of the joist 20 is mounted in a top-chord bearing relationship wherein the extension 36 of the joist 20 is seated on top of the beam B. The second end of the joist 20 is extension free, i.e. it does not include an extension 36 and is mounted to the beam B in a bottom-chord bearing relationship wherein the bottom chord 28 is seated on the beam B.

In the embodiment described above in reference to the drawings, the joist end section 22 is shown in a top-chord bearing relationship with a beam B. However, it is appreciated that the beam can be replace by a wall or any other appropriate structural component. It is appreciated that the joist can run from wall to wall, wall to beam, or beam to beam to support a floor, a ceiling or a roof. It may be made of wood, metals such as steel, or concrete or any combination thereof. In a particular embodiment, the top and bottom chords 26, 28, the post(s), and the board are wooden members. As mentioned above, the board can be made from plywood, laminated veneer lumber, oriented strand board (OSB), laminated solid wood panel, and the like.

It is also appreciated that in an alternative embodiment (not shown) the joist can be in a top-chord bearing relationship at both end sections, i.e. both joist end sections include an extension 36.

Referring to FIG. 7, there is shown another alternative embodiment of the joist end configuration wherein the features are numbered with reference numerals in the 100 series which correspond to the reference numerals of the previous embodiment. In the embodiment shown in FIG. 7, the I-joist section at the end section 122 is shorter and the inner top chord 140 extends along the entire I-joist section length. On the opposite, in the embodiment shown in FIGS. 1 to 6, the I-joist section at the end section 22 is longer and the inner top chord 40 extends only along a portion thereof.

Referring to FIG. 8, there is shown another alternative embodiment of the joist end configuration wherein the features are numbered with reference numerals in the 200 series which correspond to the reference numerals of the previous embodiments. In the embodiment shown in FIG. 8, the I-joist section extends along the entire joist length, i.e. from one end section 222 to the opposed end section 222 (only one end section 222 is shown). The inner top chord 240 extends only along a section thereof. On the opposite, in the embodiments shown in FIGS. 1 to 7, the central section 24, 124 of the joist 20, 120 has an open-joist configuration with web members 33, 133 extending between the top and the bottom chords 26, 28, 126, 128.

Referring to FIG. 9, there is shown another alternative embodiment of the joist end configuration wherein the features are numbered with reference numerals in the 300 series which correspond to the reference numerals of the previous embodiments. In the embodiment shown in FIG. 9, the joist end configuration includes a double post 346 with an outer post member 348 and an inner post member 350 to further increase the mechanical properties of the resulting joist 320. In an alternative embodiment (not shown), the double post 346 can be replaced by a single post with an increased thickness.

For further clarity, metal plates 44, 144, 244 are not shown in the embodiments of FIGS. 9 to 14. However, one skilled in the art will appreciate that metal plates can be used to attach two joist components as further described above.

Referring to FIG. 10, there is shown another alternative embodiment of the joist end configuration wherein the features are numbered with reference numerals in the 400 series which correspond to the reference numerals of the previous embodiments. In the embodiment shown in FIG. 10, the post 434 has an indentation 452 defined in a lower and inner corner. The upper end corner of the bottom chord 428 is inserted in the post indentation 452. In the embodiments shown in FIGS. 1 to 9, the end of the bottom chord 28, 128, 228, 328 abuts the lateral face of the post 34, 134, 234, 334, i.e. the post 34, 134, 234, 334 is indentation free.

Referring to FIG. 11, there is shown another alternative embodiment of the joist end configuration wherein the features are numbered with reference numerals in the 500 series which correspond to the reference numerals of the previous embodiments. As the embodiment shown in FIG. 9, the joist end configuration includes a double post 546 with an outer post member 548 and an inner post member 550. Furthermore, as the embodiment shown in FIG. 10, the inner post member 550 has an indentation 552 defined in a lower and inner corner. The upper end corner of the bottom chord 528 is inserted in the post indentation 552. In an alternative embodiment (not shown), the indentation 552 can be provided in the outer post member 548 and the lower end of the inner post member 550 can abut an upper face of the bottom chord 528.

Referring to FIG. 12, there is shown another alternative embodiment of the joist end configuration wherein the features are numbered with reference numerals in the 600 series which correspond to the reference numerals of the previous embodiments. As the embodiments shown in FIGS. 9 and 11, the joist end configuration includes a double post 646 with an outer post member 648 and an inner post member 650. However, none of the posts 648, 650 includes an indentation. The lower end of the inner post member 650 abuts an upper face of the bottom chord 628 while the end of the bottom chord 628 abuts a lateral face of the outer post member 648.

Referring to FIG. 13, there is shown another alternative embodiment of the joist end configuration wherein the features are numbered with reference numerals in the 700 series which correspond to the reference numerals of the previous embodiments. The thickness of the post 734 is increased in comparison with the posts 34, 134, 234 of the above described embodiments. Furthermore, in contrast of the posts described above, the post 734 does not include an elongated groove in which an edge of the board 730 is inserted. Instead, a lateral edge of the board 730 abuts, without being inserted, the post 734 and is secured thereto with an adhesive or fasteners such as nails, screws, and the like or combination thereof. The lower end of the post 734 abuts an upper face of the bottom chord 728.

Referring to FIG. 14, there is shown another alternative embodiment of the joist end configuration wherein the features are numbered with reference numerals in the 800 series which correspond to the reference numerals of the previous embodiments. On the opposite of the above described embodiments, the post 834 does not extend substantially vertically, i.e. substantially perpendicular to the double top and bottom chords 836, 828. The post 834 extends diagonally between the double top and bottom chords 836, 828. In the embodiment shown, the bottom chord 828 extends beyond a lower end of the post 834. However, it is appreciated that, in an alternative embodiment (not shown), the bottom chord 828 can end at the intersection of the post 834 and the bottom chord 828.

Now that plurality of embodiments of joist-end configurations are described, it is appreciated that combinations of the above-described embodiments (FIGS. 1 to 14) are possible.

Referring now to FIGS. 15 to 17, three embodiments showing connections between the double top chord 38, the post 34, the bottom chord 28, and the board 30 will be described for the joist end section 22 described above in reference to FIGS. 1 to 6. In the embodiment shown in FIG. 15, the joist end section 22 includes a single board 30 which extends through the elongated groove 42 defined in the inner top chord 40 and has an upper edge inserted in the elongated groove 42 of the outer top chord 26. The board 30 has also edges inserted respectively in the elongated post groove 35 and in an elongated groove defined in the bottom chord 28.

In the embodiment shown in FIG. 16, the joist end section 22 also includes a single board 30. As the embodiment shown in FIG. 15, the board 30 has edges inserted in the elongated post groove 35 and in the elongated groove defined in the bottom chord 28. However, in the double top chord section of the end section 22, the board 30 does not extend through the elongated groove 42 defined in the inner top chord 40 but the upper edge of the board 30 is located therein. In the remaining inner section of end section 22, the upper edge of the board 30 is inserted in the outer top chord 26.

In the embodiment shown in FIG. 17, the joist 22 includes at least two boards 30*a*, 30*b* separated from one another by an inner post 60. As the embodiments shown in FIGS. 15 and 16, the outer board 30*a* has edges inserted in the elongated post groove 35 and in the elongated groove defined in the bottom chord 28. The upper edge of the outer board 30*a* is located in the inner top chord 40, i.e. the outer board 30*a* does not extend through the inner top chord 40. An inner edge of the outer board 30*a* is inserted in the inner post 60. The upper, outer, and lower edges of the inner board 30*b* are respectively inserted in the outer top chord 26, the inner post 60, and the bottom chord 28.

It is appreciated that other connections between the various joist components are possible. Furthermore, the connections can be adapted to the other end section embodiments described above or a combinations thereof.

It is appreciated that with the above described joist end sections, no joist hangers are required to mount the joist in a top chord bearing configuration. The double top chord increases the load bearing capacity of the joist, without substantially increasing its weight. Furthermore, the end section is designed to be mounted to a beam in a top-chord bearing relationship. In comparison with bottom-chord bearing joist, with top-chord bearing joists, at least a section of the bearing structure, such as the beams and the walls, can be at least partially hidden, the peripheral wall insulation can be simplified, and the joist stability during installation can be increased.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention. The scope of the invention is therefore intended to be limited solely by the scope of the appended claims.

The invention claimed is:

1. A joist comprising:

an outer top chord and a bottom chord; and an end configuration with at least one end of the joist and including a board connecting the outer top chord and the bottom chord, an inner top chord underlying the outer top chord and defining therewith a double top chord section, a post extending between the bottom chord and the double top chord section and juxtaposed outwardly to the board and toward the end of the joist, the double top chord section extending outwardly past the post and the bottom chord, the inner top chord having an elongated inner top chord groove defined therein with at least a section of the board being inserted in the elongated inner top chord groove.

2. A joist as claimed in claim 1, wherein the board extends through the elongated inner top chord groove and has an edge at least partially inserted in an elongated groove defined in the outer top chord.

3. A joist as claimed in claim 1, wherein the board has an edge at least partially located in the elongated inner top chord groove.

4. A joist as claimed in claim 1, wherein at least one of the outer top chord, the inner top chord, the bottom chord, and the post is a wooden member and wherein the joist further comprises a first set of metal plates in alignment on opposed sides of the joist to connect the double top chord section and an upper end of the post.

5. A joist as claimed in claim 1, wherein the post comprises an elongated post groove in which an outer edge of the board is at least partially inserted.

6. A joist as claimed in claim 1, wherein the double top chord section defines a joist extension extending outwardly past the bottom chord for supporting the joist in a top chord bearing relationship.

7. A joist as claimed in claim 1, wherein the post is substantially perpendicular to the double top chord section and the bottom chord.

8. A joist as claimed in claim 1, wherein the inner and the outer top chords are in direct juxtaposition and extend substantially parallel to one another.

9. A joist as claimed in claim 1, wherein the inner top chord extends inwardly past the post and an end of the post abuts a lower face of the inner top chord.

10. A joist as claimed in claim 1, further comprising a central section including at least one of a board and web members connecting the outer top and bottom chords and metal plates securing an inner end of the inner top chord to the outer top chord.

11. A joist comprising:

a bottom chord;

a double top chord extending outwardly past the bottom chord at an end section of the joist and including an outer top chord member extending along the joist and an inner top chord having an elongated groove defined therein;

a board connecting the double top chord and the bottom chord and having a section inserted in the elongated groove defined in the inner top chord; and a post extending in the end section of the joist between the double top chord and the bottom chord, the post being juxtaposed outwardly to the board and toward the end of the joist, and, the double top chord extending outwardly past the post.

12. A joist as claimed in claim 11, wherein the board extends through the elongated groove defined in the inner top chord and has an edge at least partially inserted in an elongated groove defined in the outer top chord.

13. A joist as claimed in claim 11, wherein the board has an edge at least partially located in the elongated groove defined in the inner top chord.

14. A joist as claimed in claim 11, wherein at least one of the outer top chord, the inner top chord, the bottom chord, and the post is a wooden member and the joist further comprises a first set of metal plates in alignment on opposed sides of the joist to connect the double top chord and an upper end of the post.

15. A joist as claimed in claim 11, wherein the post comprises an elongated post groove in which an outer edge of the board is at least partially inserted.

16. A joist as claimed in claim 11, wherein the double top chord defines a joist extension extending outwardly past the bottom chord for supporting the joist in a top chord bearing relationship.

17. A joist as claimed in claim 11, wherein the inner and the outer top chords are in direct juxtaposition and extend substantially parallel to one another.

18. A joist as claimed in claim 11, wherein the post is substantially perpendicular to the double top chord and the bottom chord, the inner top chord extends inwardly past the post and an end of the post abuts a lower face of the inner top chord.

19. A joist as claimed in claim 11, further comprising a central section including at least one of a board and web members connecting the outer top and the bottom chords and metal plates securing an inner end of the inner top chord to the outer top chord.

20. A joist comprising:

a bottom chord;

an outer top chord extending past the bottom chord at an end section of the joist;

a board connecting the outer top and bottom chords and extending at least in the end section of the joist;

an inner top chord underlying the outer top chord, extending past the bottom chord for supporting the joist in a top-chord bearing configuration, and having an elongated groove defined therein in which the board is inserted; and a post extending between the inner top chord and the bottom chord and being juxtaposed outwardly to the board and toward the end of the joist.

21. A joist as claimed in claim 20, wherein the board extends through the elongated groove defined in the inner top chord and has an edge at least partially inserted in an elongated groove defined in the outer top chord.

22. A joist as claimed in claim 20, wherein the board has an edge at least partially located in the elongated groove defined in the inner top chord.

23. A joist as claimed in claim 20, wherein at least one of the outer top chord, the inner top chord, the bottom chord, and the post is a wooden member and the joist comprises a first set of metal plates in alignment on opposed sides of the joist to connect the inner and outer top chords and an upper end of the post.

24. A joist as claimed in claim 20, wherein the post comprises an elongated post groove in which an outer edge of the board is at least partially inserted.

25. A joist as claimed in claim 20, wherein the inner and the outer top chords define a joist extension extending outwardly past the bottom chord for supporting the joist in the top-chord bearing relationship.

26. A joist as claimed in claim 20, wherein the post is substantially perpendicular to the inner and the outer top chords and the bottom chord.

27. A joist as claimed in claim 20, wherein the inner and the outer top chords are in direct juxtaposition and extend substantially parallel to one another.

28. A joist as claimed in claim 20, wherein the inner top chord extends inwardly past the post and an end of the post abuts a lower face of the inner top chord.

29. A joist as claimed in claim 20, further comprising a central section including at least one of a board and web members connecting the outer top and bottom chords and metal plates securing an inner end of the inner top chord to the outer top chord.

* * * * *